US009193177B1

(12) United States Patent
LeFevre et al.

(10) Patent No.: US 9,193,177 B1
(45) Date of Patent: Nov. 24, 2015

(54) SYSTEM FOR REDUCING COCKLE IN MEDIA PRINTED BY AN INKJET PRINTER

(71) Applicant: Xerox Corporation, Norwalk, CT (US)

(72) Inventors: Jason M. LeFevre, Penfield, NY (US); Douglas K. Herrmann, Webster, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/477,028

(22) Filed: Sep. 4, 2014

(51) Int. Cl.

| | |
|---|---|
| ***B41J 2/01*** | (2006.01) |
| ***B41J 11/00*** | (2006.01) |
| ***B41J 2/21*** | (2006.01) |
| *B41M 5/00* | (2006.01) |

(52) U.S. Cl.
CPC ..... *B41J 11/0005* (2013.01); *B41J 2/2114* (2013.01); *B41J 2/2117* (2013.01); *B41M 5/0011* (2013.01)

(58) Field of Classification Search
None
See application file for complete search history.

(56) References Cited

U.S. PATENT DOCUMENTS

| | | | | |
|---|---|---|---|---|
| 5,635,969 | A | 6/1997 | Allen | |
| 7,748,816 | B2 | 7/2010 | Koase | |
| 8,215,759 | B2 | 7/2012 | Steed et al. | |
| 8,480,199 | B2 | 7/2013 | Chen et al. | |
| 2008/0241398 | A1 * | 10/2008 | Kato et al. | 427/288 |

* cited by examiner

*Primary Examiner* — Lisa M Solomon
(74) *Attorney, Agent, or Firm* — Maginot Moore & Beck LLP

(57) ABSTRACT

A printer attenuates curl in media sheets being printing by the printer. The printer includes a moisture ejecting subsystem that ejects a water-containing material in the margins of the media sheet in the cross-process direction to reduce a moisture gradient across the media sheet when the grain of the media is parallel to the process direction of the media moving through the printer.

20 Claims, 4 Drawing Sheets

SYSTEM FOR REDUCING COCKLE IN MEDIA PRINTED BY AN INKJET PRINTER

TECHNICAL FIELD

The device disclosed in this document relates to inkjet printers that eject ink directly onto media and, more particularly, to inkjet printers that eject aqueous ink.

BACKGROUND

In general, inkjet printing machines or printers include at least one printhead that ejects drops or jets of liquid ink onto a recording or image forming surface. In some inkjet printers, the printhead ejects ink directly onto the surface of media as the media passes the printhead. The media can be in the form of a continuous web or in the form of sheets. In continuous web printers, the media is pulled from a supply roll by actuator-driven rollers. As the web moves through the printer it passes around rollers to which tension is applied to keep the web taut as it passes through the printer to a take-up roll. In sheet printers, actuator-driven rollers are positioned against one another to form nips and these nips urge the sheets through the printer.

In inkjet printers that eject ink directly onto sheets, media deformation occurs more frequently in sheet printers than continuous web printers since a web is generally taut as it passes through the printer. Sheets having leading and trailing edges that can get caught in structure and wrinkled. Additionally, the sheets can absorb moisture in the inks ejected onto the sheets and this moisture can cause curling or other deformations in the media. These deformations are particularly troublesome in inkjet printers that employ water-based or solvent-based inks in which pigments or other colorants are suspended or in solution. The water and solvents in the inks can change the physical properties of the sheets in ways that degrade the quality of the images produced on the media sheets. Consequently, most aqueous ink printers form the ink images on a blanket mounted to a drum or endless belt and then transfer the ink image to media sheets as they pass through a nip formed with the drum or endless belt. Such a printer avoids the changes in image quality, drop spread, and media properties that occur in response to media contact with the water or solvents in aqueous ink. Addressing the media property changes would enable inkjet printers to eject ink directly onto media without adversely impacting image quality.

SUMMARY

An apparatus that compensates for media property changes caused by moisture in ink has been developed. The apparatus includes at least one printhead configured to eject drops of water-containing material onto media conveyed through the printer along a transport path, the at least one printhead being positioned to eject the water-containing material onto the media prior to the media reaching a printhead assembly that ejects ink in the printer, the at least one printhead having a width in a cross-process direction, which is perpendicular to a process direction along the transport path to enable the at least one printhead to eject the drops of water-containing material onto portions of the media that are outside a first portion of the media into which the printhead assembly ejects drops of ink, and a controller operatively connected to the at least one printhead, the controller being configured to operate the at least one printhead to eject the drops of water-containing material onto portions of the media that are outside the first portion of the media in the cross-process direction to reduce a moisture gradient between an ink image to be formed by the ink ejected from the printhead assembly in the first portion of the media, the portions of the media outside of the first portion of the media being in the cross-process direction.

A printer incorporates the apparatus to compensate for media property changes caused by moisture in ink. The printer includes a transport path configured to convey media through the printer in a process direction, a printhead assembly positioned opposite a first portion of the transport path, the printhead assembly being configured with printheads to eject drops of ink into a first portion of the media conveyed by the transport path past the printhead assembly in the process direction, at least one other printhead positioned opposite a second portion of the transport path, the at least one other printhead being configured to eject drops of water-containing material onto the media conveyed by the transport path past the at least one other printhead in the process direction prior to the media reaching the printhead assembly, the at least one other printhead having a width in a cross-process direction, which is perpendicular to the process direction in a plane parallel to the path past the printhead assembly and the at least one other printhead, to enable the at least one other printhead to eject the drops of water-containing material onto portions of the media that are outside the first portion of the media into which the printheads of the printhead assembly ejects the drops of ink, and a controller operatively connected to the printheads of the printhead assembly and the at least one other printhead, the controller being configured to operate the printheads of the printhead assembly to eject ink into the first portion of the media to form an ink image that corresponds to image data received by the controller and to operate the at least one other printhead to eject the drops of water-containing material onto the portions of the media that are outside the first portion of the media in the cross-process direction to reduce a moisture gradient between the ink image to be formed by printheads of the printhead assembly in the first portion of the media and the portions of the media outside of the first portion of the media in the cross-process direction.

A method of operating a printer helps compensate for media property changes caused by moisture in ink. The method includes conveying media along a transport path through the printer in a process direction, ejecting drops of ink with printheads in a printhead assembly positioned opposite a first portion of the transport path, the ink drops being ejected into a first portion of the media conveyed along the transport path as the media is conveyed past the printhead assembly in the process direction, ejecting drops of water-containing material with at least one other printhead positioned opposite a second portion of the transport path onto the media conveyed by the transport path past the at least one other printhead in the process direction prior to the media reaching the printhead assembly, the at least one other printhead having a width in a cross-process direction, which is perpendicular to the process direction in a plane parallel to the path past the printhead assembly and the at least one other printhead, to enable the at least one other printhead to eject the drops of water-containing material onto portions of the media that are outside the first portion of the media into which the printheads of the printhead assembly ejects the drops of ink, and operating with a controller the printheads of the printhead assembly to eject ink into the first portion of the media to form an ink image that corresponds to image data received by the controller and to operate the at least one other printhead to eject the drops of water-containing material onto the portions of the media that are outside the first portion of the media in the cross-process direction to reduce a moisture gradient between the ink image to be formed by printheads of the printhead assembly in the first portion of the media and the portions of the media outside of the first portion of the media in the cross-process direction.

BRIEF DESCRIPTION OF THE DRAWINGS

The foregoing aspects and other features of an apparatus or printer that compensates for media property changes caused by moisture in ink are explained in the following description, taken in connection with the accompanying drawings.

DETAILED DESCRIPTION

Figure 1:
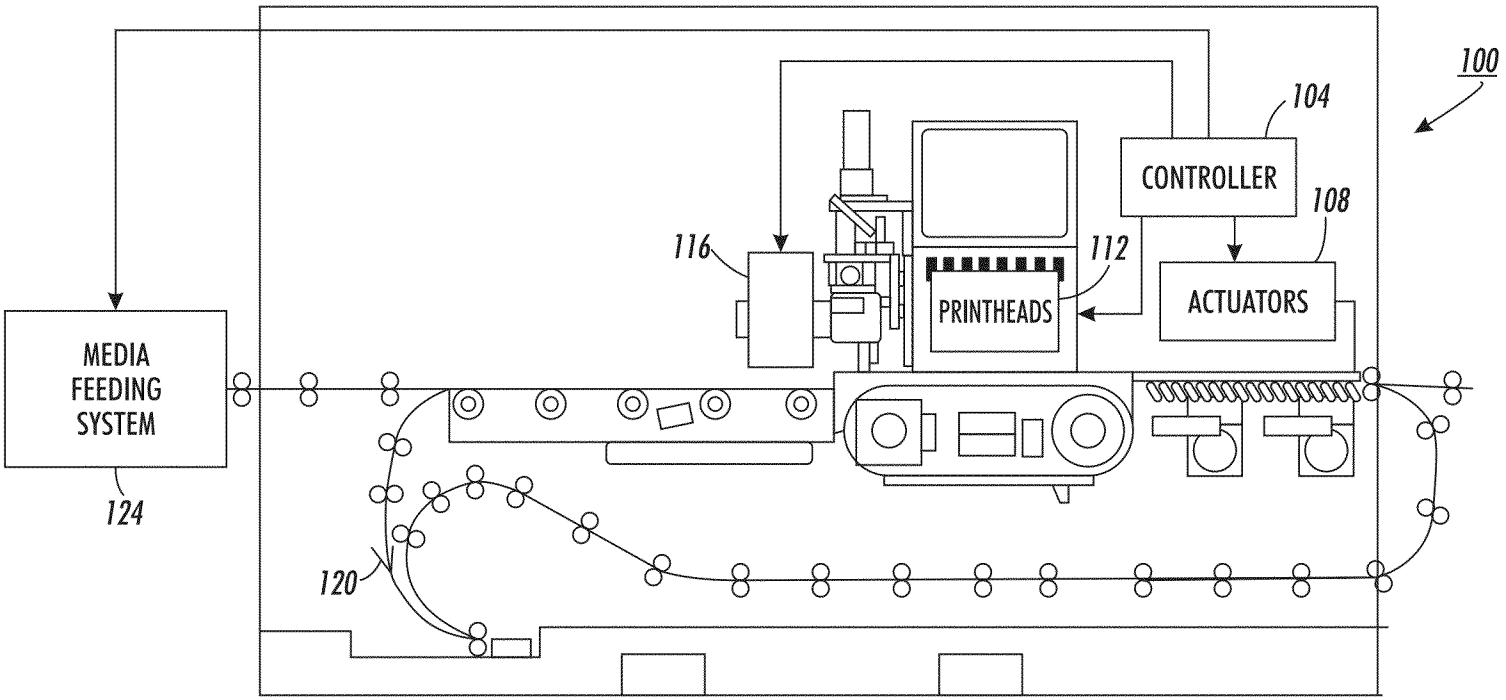
FIG. 1 is diagram of an inkjet printer that compensates for moisture in inks prior to media being printed.

For a general understanding of the environment for the device disclosed herein as well as the details for the device, reference is made to the drawings. In the drawings, like reference numerals designate like elements. As used herein, the terms "printer," "printing device," or "imaging device" generally refer to a device that produces an image on print media with liquid ink and may encompass any such apparatus, such as a digital copier, bookmaking machine, facsimile machine, multi-function machine, or the like, which generates printed images for any purpose. Image data generally include information in electronic form that a controller renders and uses to operate the inkjet ejectors in printheads in the printer to compensate for moisture in ink and to form an ink image on media sheets. These data can include text, graphics, pictures, and the like. The operation of producing images with colorants on print media, for example, graphics, text, photographs, and the like, is generally referred to herein as printing or marking. Aqueous inkjet printers are printers that use inks having a high percentage of water relative to the amount of colorant and/or solvent in the ink.

The term "printhead" as used herein refers to a component in the printer that is configured with inkjet ejectors to eject water-containing drops or ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in a solution, suspension or dispersion with a liquid solvent that includes water and/or one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

FIG. 1 shows a configuration of an inkjet printer 100 that has been configured with a moisture ejecting printhead that applies moisture to portions of media sheets passing through the printer before the printheads eject ink onto the media sheets. The printer 100 includes a controller 104, one or more actuators 108, a printhead assembly 112, a moisture ejecting subsystem 116, a transport subsystem 120 and a media feeding subsystem 124. The controller is operatively connected to the actuators 108, the printhead assembly 112, the moisture ejecting subsystem 116, and the media feeding subsystem 124. The controller 104 is configured to receive image data from an image data source and generate firing signals for the operation of the printheads in the printhead assembly 120 for the formation of ink images on media sheets as the sheets pass by the printheads. The media sheets are stored in the media feeding subsystem 124 and the controller operates the media feeding subsystem to retrieve media sheets from the storage receptacle for the sheets and feed the sheets into the transport subsystem 120. The controller operates the actuators 108 to drive rollers within the transport system 120 to move the media sheets along a path in the transport subsystem that passes the sheets past the moisture ejecting subsystem 116 and the printhead assembly 112. The sheets are then either ejected from the transport subsystem into a receptacle (not shown) for retrieval or they are diverted to the lower path of the transport subsystem. The lower path is configured for flipping the sheets over so the unprinted side of the sheets can be returned to the path past the moisture ejecting subsystem and the printhead assembly before being directed into the receptacle for retrieval.

As used herein, the term "process direction" refers to movement along the path in the transport subsystem that moves the sheets past the moisture ejecting subsystem 116 and the printhead assembly 112 and "cross-process direction" refers to a direction orthogonal to the process direction axis in the plane of the path past those two subsystems.

To operate the inkjet ejectors in the printheads of the printhead assembly 112, the controller 104 receives a file of image data of an image to be produced on the media sheet. This image can include text alone, graphics alone, or a combination of text and graphics. These image data can be provided by a scanner or by an application program in a known manner. The controller 104 generates color separations and renders the color separations to produce halftone data. These halftone data can be provided to a processor in the printhead assembly 112 for the generation of firing signals or the controller can generate the firing signals and download them to a printhead controller in the assembly 112. The printhead assembly then operates the inkjet ejectors in the printheads of the printhead assembly 112 to eject ink drops onto the media sheet as the sheet passes the printheads to form an ink image on the sheet. Additionally, the controller 104 generates signals to operate one or more of the actuators 108 to coordinate the movement of media sheet and the operation of the inkjet ejectors in the printheads of the printhead assembly 112.

Figure 2:
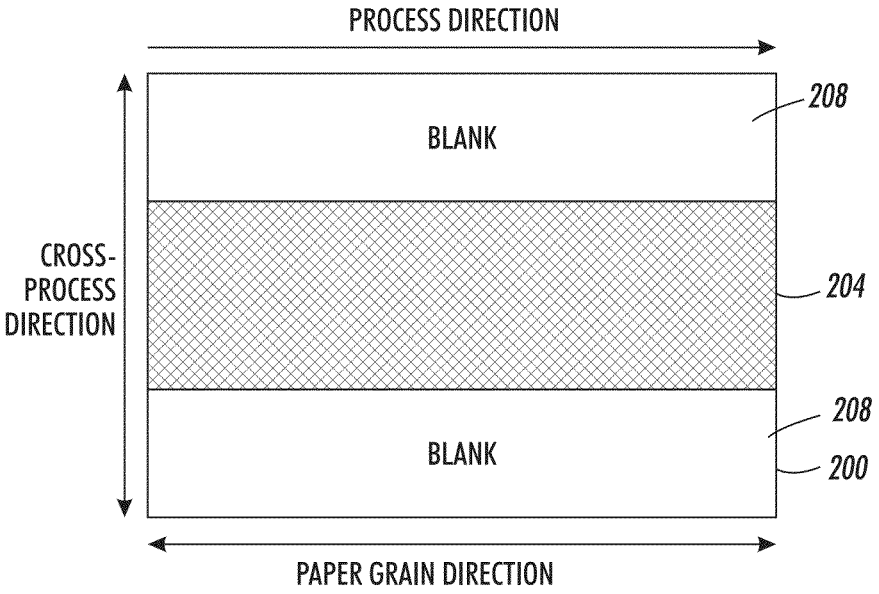
FIG. 2 is a diagram of a media sheet that illustrates the parameters that affect curl caused by moisture in ink.

To explain the principles for addressing curl in media sheets with the moisture ejecting subsystem 116, reference is made to FIG. 2. FIG. 2 depicts a media sheet 200. Media sheets, particularly paper sheets, have a grain direction. Although the grain of a media sheet can be in either the process or cross-process direction, the sheet 200 is depicted as having a grain in the process direction or opposite of the process direction. The sheet 200 includes a print zone 204 and margin areas 208. The print zone 204 is the area of the sheet 200 into which at least one of the printheads in the printhead assembly 112 is capable of ejecting ink. The margin areas 208 are areas that are beyond a cross-process direction width of the printheads so no ink is capable of being ejected into these areas. When a significant amount of water-containing ink is ejected into the print zone 204 and the margins are relatively dry, the media sheet is more likely to "curl" in a manner that is parallel to the process direction of the sheet. This curl is a function of the moisture gradient across the media sheet in the cross-process direction. Since the moisture gradient goes from dry to relatively wet to dry, the media sheet curls. Making the moisture concentration more consistent in the cross-process direction by ejecting moisture into the margin zones 208 helps mitigate curl in the media sheet that is parallel to the process direction. For a media sheet having a grain direction in the cross-process direction, moisture needs to be ejected into the leading and trailing portions of the media outside of the print zone to mitigate the occurrence of curl in the process direction.

In the moisture ejecting subsystem 116, one or more printheads are provided. These printheads are configured to extend in the cross-process direction from one edge of the a media sheet to other opposite edge. Thus, the printhead or printheads in the moisture ejecting subsystem extend beyond the width of the printheads in the printhead assembly 112 in the cross-process direction. The printheads in the moisture ejecting subsystem need not have as fine a resolution as the printheads ejecting ink in the printhead assembly because the moisture ejecting printheads eject drops of water, a water-containing solution, or any equivalent solution to water. Water drop placement does need not to be as precise as ink drop placement because water is colorless and registration of the water drops is not required. Thus, more economical printheads such as the 300 dpi printheads made by FUJIFILM Dimatix, Inc. of Santa Clara, Calif. can be used in the moisture ejecting subsystem 116. "Resolution" means that inkjets in the printheads of the printhead assembly are separated from one another in the cross-process direction by a distance that is less than a distance separating inkjets in the printheads of the moisture ejecting subsystem from one another in the cross-process direction. Additionally, the printheads in the moisture ejecting subsystem 116 are separated from the media passing by the printheads by a distance that is greater than a distance separating the printheads in the printhead assembly from the media as the media passes those printheads in the process direction. The moisture ejecting subsystem 116 can be configured as an assembly as shown in FIG. 1 and incorporated as an apparatus in existing printers. In this apparatus embodiment, the controller described below that receives image data and generates the firing signals for operating the one or more printheads that eject water-containing material is located within the apparatus assembly and communicates with the controller operating the printer to compensate for the moisture gradients. Alternatively, a printer can be configured with the components as described herein to provide the printer with the advantages of the moisture ejecting subsystem 116 to address media curl.

Figure 3:
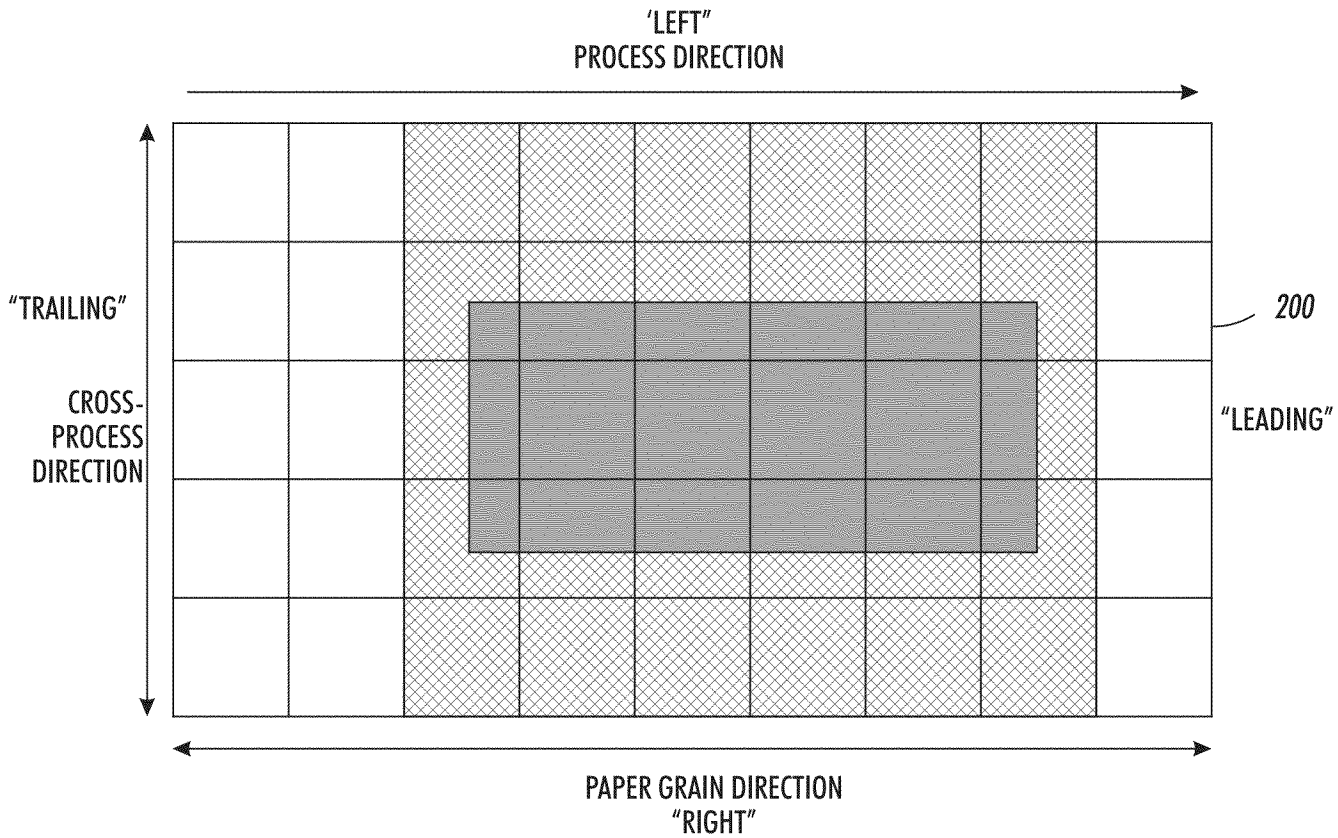
FIG. 3 is a diagram of a media sheet and the grid used to evaluate the positions where anti-curl material should be applied to compensate for moisture in inks being ejected onto the media.

The operation of the moisture ejecting subsystem 116 to attenuate curl on media sheets is now described with reference to FIG. 3. In that figure, a media sheet 200 moves in the process direction so the leading edge is to the right of figure and the trailing edge is to the left. As explained above, the controller 104 receives image data and analyzes the image data to generate color separations and then renders that data to generate halftone data of the image to be printed. The controller 104 also uses these data to identify areas in which over half of the pixels in a grid within the print zone are to be printed with ink. These areas are areas in which the moisture gradient from one edge of the media sheet to the other edge of the sheet in the cross-process direction is likely to result in curl. While one embodiment uses fifty percent of the pixels in a grid being printed as a threshold for determining curl, other thresholds are possible depending on the porosity of the media sheet, the viscosity of the ink, and possibly, environmental conditions, such as temperature and humidity, in the vicinity of the print zone.

Figure 4:
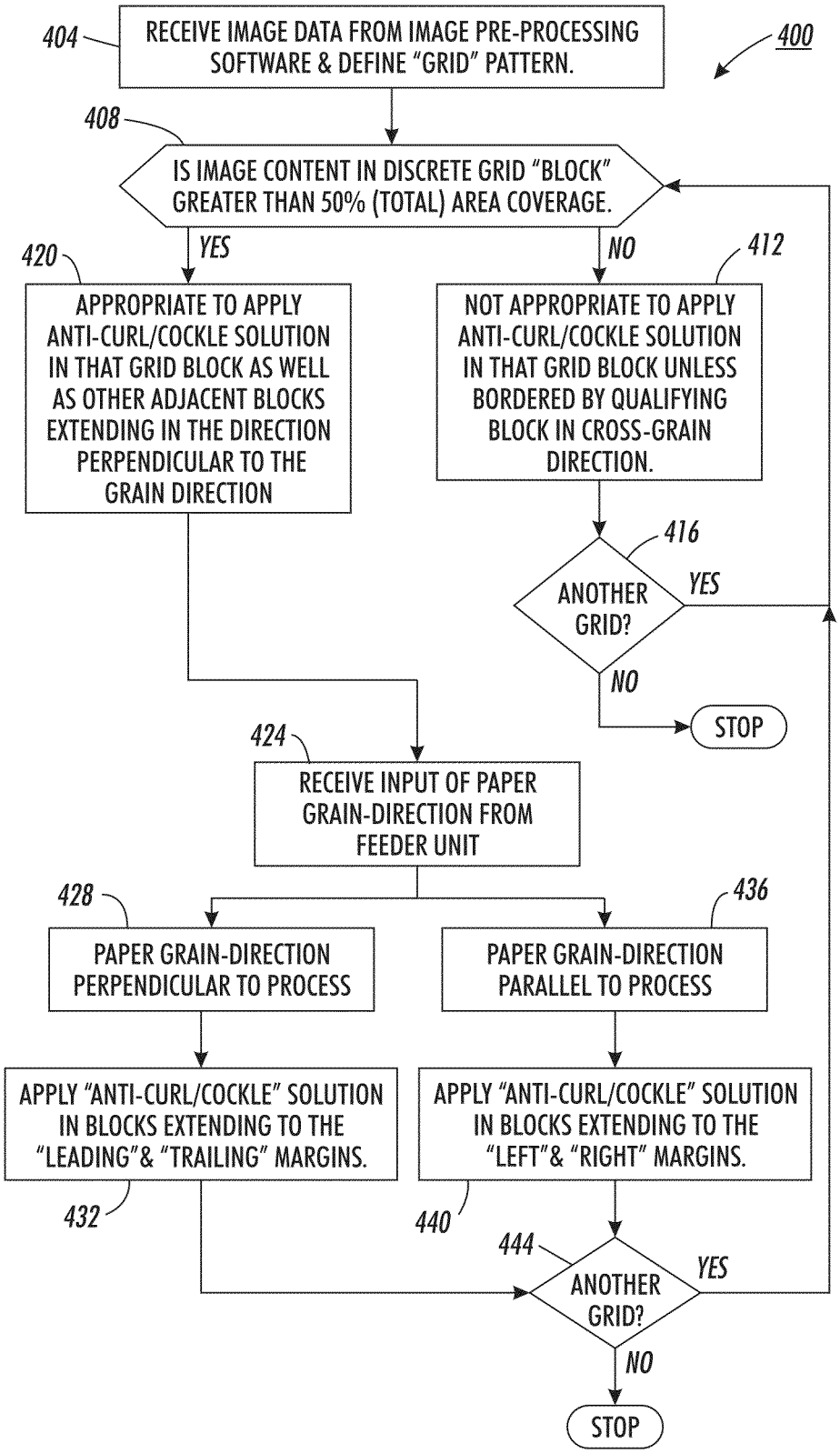
FIG. 4 is a flow diagram of a process for compensating for moisture in inks being ejected onto media.

A method of operating a printer that mitigates curl in media sheets is shown in FIG. 4. In the description of this method, statements that a process is performing some task or function refers to a controller or general purpose processor executing programmed instructions stored in a memory operatively connected to the controller or processor to manipulate data or to operate one or more components in the printer to perform the task or function. The controller 104 noted above can be such a controller or processor. Alternatively, this controller can be implemented with more than one processor and associated circuitry and components, each of which is configured to form one or more tasks or functions described herein.

At the beginning of a media sheet printing operation, the controller 104 receives a data file of image data for the image and determines a grid pattern for the mage (block 404). The controller 104 generates color separation data and then renders the data to distribute the halftone data across the grids and then evaluates on a grid by grid basis whether moisture needs to be ejected onto the media sheet in non-printed areas (block 408). If the number of pixels to be printed in a grid is less than a predetermined threshold, for example, fifty percent, no moisture is required to address the possibility of curl in the media sheet (block 412) and the process checks to see if another grid is to be processed (block 416). If another grid remains to be processed, the method continues at block 408. Otherwise, the process stops.

If the number of pixels to be printed in a grid is equal to or greater than the predetermined threshold, for example, fifty percent, moisture is required to address the possibility of curl in the media sheet (block 420). The controller 104 receives from the media feeding subsystem 124 a signal that indicates whether the grain direction of the media is perpendicular or parallel to the process direction (block 424). If the sheet grain is perpendicular to the process direction (block 428), then the controller 104 generates firing signals to operate the inkjet ejectors in the moisture ejecting subsystem 116 to eject water-containing material in grids at the leading and trailing edges that are aligned with the grid in the print zone in the process direction (block 432). If the sheet grain is parallel to the process direction (block 436), then the controller 104 generates firing signals to operate the inkjet ejectors in the moisture ejecting subsystem 116 to eject water-containing material in grids at the left and right margins that are aligned with the grid in the print zone in the cross-process direction (block 440). The firing signals are generated to operate a number of inkjets to eject an amount of water-containing material that corresponds to ink content in the grid determined at block 408. For example, if the ink coverage in a grid is seventy percent, then the ejectors in the moisture ejecting subsystem are operated to eject an amount of water-containing material that covers approximately seventy percent of the grids in the non-printed area of the sheet. Alternatively, if multiple grids in a cross-process or process direction of the print zone require the moisture ejecting subsystem to be operated, an average of the ink coverage in the grids of the print zone could be used to generate the firing signals. In another embodiment, the grid in which the ink coverage is the greatest could be used to generate the firing signals to eject a corresponding amount of water-containing material in the grids of the non-printed area. Once the firing signals are generated and delivered to the moisture ejecting subsystem 116 (blocks 432 and 440), the process checks to see if another grid is to be processed (block 444). If another grid remains to be processed, the method continues at block 408. Otherwise, the process stops. The firing signals delivered to the moisture ejecting subsystem 116 operate the printheads to eject the water-containing material into the appropriate grids of the media sheet prior to the media sheet moving past the printheads in the printhead assembly 112. The application of the water-containing material helps attenuate any curl in the media sheet that would potentially cause the media sheet to deform while present in the area opposite the printheads in the printhead assembly.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printer comprising:

a transport path configured to convey media through the printer in a process direction;

a printhead assembly positioned opposite a first portion of the transport path, the printhead assembly being configured with printheads to eject drops of ink into a first portion of the media conveyed by the transport path past the printhead assembly in the process direction;

at least one other printhead positioned opposite a second portion of the transport path, the at least one other printhead being configured to eject drops of water-containing material onto the media conveyed by the transport path past the at least one other printhead in the process direction prior to the media reaching the printhead assembly, the at least one other printhead having a width in a cross-process direction, which is perpendicular to the process direction in a plane parallel to the path past the printhead assembly and the at least one other printhead, to enable the at least one other printhead to eject the drops of water-containing material onto portions of the media that are outside the first portion of the media into which the printheads of the printhead assembly ejects the drops of ink; and a controller operatively connected to the printheads of the printhead assembly and the at least one other printhead, the controller being configured to operate the printheads of the printhead assembly to eject ink into the first portion of the media to form an ink image that corresponds to image data received by the controller and to operate the at least one other printhead to eject the drops of water-containing material onto the portions of the media that are outside the first portion of the media in the cross-process direction to reduce a moisture gradient between the ink image to be formed by printheads of the printhead assembly in the first portion of the media and the portions of the media outside of the first portion of the media in the cross-process direction.

2. The printer of claim 1, the controller being further configured to:

analyze the image data received by the controller; and generate firing signals for operating the at least one other printhead to eject the drops of the water-containing material onto the portions of the media outside of the first portion of the media in the cross-process direction with reference to the image data received by the controller to reduce the moisture gradient between the ink image to be formed by the printheads in the printhead assembly in the first portion of the media and the portions of the media outside of the first portion of the media in the cross-process direction.

3. The printer of claim 2, the controller being further configured to analyze the image data by:

identifying an amount of ink to be ejected onto the first portion of the media; and generating the firing signals in response to the amount of ink being equal to or greater than a predetermined threshold.

4. The printer of claim 2, the controller being further configured to analyze the image data by:

identifying an amount of ink to be ejected onto a grid within the first portion of the media; and generating the firing signals in response to the amount of ink in the grid being equal to or greater than a predetermined threshold.

5. The printer of claim 4, the controller being further configured to analyze the image data by:

receiving a signal indicative of a grain direction for the media; and generating the firing signals to eject the water-containing material in the portions outside of the first portion in response to the signal indicative of the grain direction of the media indicating the media grain is parallel to the process direction.

6. The printer of claim 1 wherein a resolution of the printheads in the printhead assembly is greater than a resolution of the at least one other printhead.

7. The printer of claim 1 wherein the printheads of the printhead assembly are separated from the media passing by the printheads in the process direction by a distance that is less than a distance separating the at least one other printhead from the media passing the at least one other printhead in the process direction.

8. A method of operating a printer comprising:

conveying media along a transport path through the printer in a process direction;

ejecting drops of ink with printheads in a printhead assembly positioned opposite a first portion of the transport path, the ink drops being ejected into a first portion of the media conveyed along the transport path as the media is conveyed past the printhead assembly in the process direction;

ejecting drops of water-containing material with at least one other printhead positioned opposite a second portion of the transport path onto the media conveyed by the transport path past the at least one other printhead in the process direction prior to the media reaching the printhead assembly, the at least one other printhead having a width in a cross-process direction, which is perpendicular to the process direction in a plane parallel to the path past the printhead assembly and the at least one other printhead, to enable the at least one other printhead to eject the drops of water-containing material onto portions of the media that are outside the first portion of the media into which the printheads of the printhead assembly ejects the drops of ink; and operating with a controller the printheads of the printhead assembly to eject ink into the first portion of the media to form an ink image that corresponds to image data received by the controller and to operate the at least one other printhead to eject the drops of water-containing material onto the portions of the media that are outside the first portion of the media in the cross-process direction to reduce a moisture gradient between the ink image to be formed by printheads of the printhead assembly in the first portion of the media and the portions of the media outside of the first portion of the media in the cross-process direction.

9. The method of claim 8 further comprising:

analyzing the image data; and generating firing signals for operating the at least one other printhead to eject the drops of the water-containing material onto the portions of the media outside of the first portion of the media in the cross-process direction with reference to the image data received by the controller to reduce the moisture gradient between the ink image to be formed by the printheads in the printhead assembly in the first portion of the media and the portions of the media outside of the first portion of the media in the cross-process direction.

10. The method of claim 9, the analysis of the image data further comprising:

identifying an amount of ink to be ejected onto the first portion of the media; and generating the firing signals in response to the amount of ink being equal to or greater than a predetermined threshold.

11. The method of claim 9, the analysis of the image data further comprising:

identifying an amount of ink to be ejected onto a grid within the first portion of the media; and generating the firing signals in response to the amount of ink in the grid being equal to or greater than a predetermined threshold.

12. The method of claim 11, the analysis of the image data further comprising:

receiving a signal indicative of a grain direction for the media; and generating the firing signals to eject the water-containing material in the portions outside of the first portion in response to the signal indicative of the grain direction of the media indicating the media grain is parallel to the process direction.

13. The method of claim 9 wherein a resolution of the printheads in the printhead assembly is greater than a resolution of the at least one other printhead.

14. The method of claim 9 wherein the printheads of the printhead assembly are separated from the media passing by the printheads in the process direction by a distance that is less than a distance separating the at least one other printhead from the media passing the at least one other printhead in the process direction.

15. An apparatus for incorporation in a printer comprising:

at least one printhead configured to eject drops of water-containing material onto media conveyed through the printer along a transport path, the at least one printhead being positioned to eject the water-containing material onto the media prior to the media reaching a printhead assembly that ejects ink in the printer, the at least one printhead having a width in a cross-process direction, which is perpendicular to a process direction along the transport path to enable the at least one printhead to eject the drops of water-containing material onto portions of the media that are outside a first portion of the media into which the printhead assembly ejects drops of ink; and a controller operatively connected to the at least one printhead, the controller being configured to operate the at least one printhead to eject the drops of water-containing material onto portions of the media that are outside the first portion of the media in the cross-process direction to reduce a moisture gradient between an ink image to be formed by the ink ejected from the printhead assembly in the first portion of the media, the portions of the media outside of the first portion of the media being in the cross-process direction.

16. The apparatus of claim 15, the controller being further configured to:

analyze image data used to operate the printhead assembly and form the ink image; and generate firing signals for operating the at least one printhead to eject the drops of the water-containing material onto the portions of the media outside of the first portion of the media in the cross-process direction with reference to the image data received by the controller to reduce the moisture gradient between the ink image to be formed by the printheads in the printhead assembly in the first portion of the media and the portions of the media outside of the first portion of the media in the cross-process direction.

17. The apparatus of claim 16, the controller being further configured to analyze the image data by:

identifying an amount of ink to be ejected onto the first portion of the media; and generating the firing signals in response to the amount of ink being equal to or greater than a predetermined threshold.

18. The apparatus of claim 16, the controller being further configured to analyze the image data by:

identifying an amount of ink to be ejected onto a grid within the first portion of the media; and generating the firing signals in response to the amount of ink in the grid being equal to or greater than a predetermined threshold.

19. The apparatus of claim 18, the controller being further configured to analyze the image data by:

receiving a signal indicative of a grain direction for the media; and generating the firing signals to eject the water-containing material in the portions outside of the first portion in response to the signal indicative of the grain direction of the media indicating the media grain is parallel to the process direction.

20. The apparatus of claim 15 wherein a resolution of the at least one printhead is less than a resolution of printheads in the printhead assembly; and the printheads in the printhead assembly are separated from the media passing by the printheads in the process direction by a distance that is less than a distance separating the at least one other printhead from the media passing the at least one other printhead in the process direction.

* * * * *